US011940219B2

(12) United States Patent
Kim et al.

(10) Patent No.: US 11,940,219 B2
(45) Date of Patent: Mar. 26, 2024

(54) HEAT EXCHANGER AND HEAT EXCHANGER MANUFACTURING METHOD

(71) Applicant: LG ELECTRONICS INC., Seoul (KR)

(72) Inventors: Sungwoo Kim, Seoul (KR); Hongseong Kim, Seoul (KR); Seungmo Jung, Seoul (KR); Hanchoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/501,256

(22) Filed: Oct. 14, 2021

(65) Prior Publication Data

US 2022/0120501 A1 Apr. 21, 2022

(30) Foreign Application Priority Data

Oct. 16, 2020 (KR) ..... 10-2020-0134403

(51) Int. Cl.

| | |
|---|---|
| ***F28F 9/02*** | (2006.01) |
| ***F28D 1/02*** | (2006.01) |
| ***F28D 1/053*** | (2006.01) |
| ***F28F 1/32*** | (2006.01) |

(Continued)

(52) U.S. Cl.

CPC ..... *F28D 1/05333* (2013.01); *F28D 1/0233* (2013.01); *F28D 1/0246* (2013.01); *F28F 1/32* (2013.01); *F28F 9/0131* (2013.01); *F28F 9/0221* (2013.01); *F28F 9/262* (2013.01); *F28F 2275/045* (2013.01); *F28F 2280/00* (2013.01)

(58) Field of Classification Search

CPC ..... F28F 9/0221; F28F 1/22

See application file for complete search history.

(56) References Cited

U.S. PATENT DOCUMENTS 6,032,728 A 3/2000 Ross et al.

FOREIGN PATENT DOCUMENTS

| | | |
|---|---|---|
| EP | 2 507 573 | 10/2012 |
| EP | 3 339 764 | 6/2018 |
| EP | 3 598 052 | 1/2020 |

(Continued)

OTHER PUBLICATIONS

European Search Report dated Feb. 18, 2022 issued in EP Application No. 21202819.5.

*Primary Examiner* — Eric S Ruppert

(74) *Attorney, Agent, or Firm* — KED & ASSOCIATES

(57) ABSTRACT

The present disclosure relates to a heat exchanger. The heat exchanger includes: a plurality of tube panels including a tube elongated in one direction; a pair of header modules coupled to both ends of the plurality of tube panels; and a pair of header cases having an open side, providing a space therein, and having the header module inserted in the space such that the tube panels communicate with the spaces, in which the header modules is composed of a plurality of header blocks stacked and coupled to each other, and an insertion hole in which the tube panel is inserted is formed at each of the plurality of header blocks. Accordingly, it is possible to increase the efficiency of manufacturing a heat exchanger, manufacture a heat exchanger flexibly in a custom-made type in accordance with the size of a product having the heat exchanger, reduce tolerance due to brazing, and improve stability of a product.

16 Claims, 19 Drawing Sheets

(51) Int. Cl.
*F28F 9/013* (2006.01)
*F28F 9/26* (2006.01)

(56) References Cited

FOREIGN PATENT DOCUMENTS

| | | | | | | |
|---|---|---|---|---|---|---|
| GB | 1575021 | A | * | 9/1980 | ..... | F28D 1/05383 |
| JP | 2013139965 | A | * | 7/2013 | | |
| KR | 10-0644135 | | | 11/2006 | | |
| KR | 20-0432601 | | | 12/2006 | | |
| KR | 20-2007-0017024 | | | 4/2009 | | |
| KR | 10-1447072 | | | 10/2014 | | |
| KR | 10-2019-0097632 | | | 8/2019 | | |
| WO | WO-2010150879 | A1 | * | 12/2010 | ..... | F28D 7/103 |

* cited by examiner

HEAT EXCHANGER AND HEAT EXCHANGER MANUFACTURING METHOD

CROSS-REFERENCE TO RELATED APPLICATION

This application claims priority under 35 U.S.C. § 119 to Korean Patent Application No. 10-2020-0134403 filed on Oct. 16, 2020, whose entire disclosure is hereby incorporated by reference.

BACKGROUND OF THE DISCLOSURE

Field of the Disclosure

The present disclosure relates to a heat exchanger and a method of manufacturing a heat exchanger and, more particularly, to a heat exchanger that is improved in manufacturing speed and manufacturing cost because it has an assembly-type header structure, that has fewer brazing apertures in a product, and that can easily cope with the specification of a product, and a method of manufacturing a heat exchanger.

Related Art

In general, a heat exchanger can be used as a condenser or an evaporator in a refrigerant cycle system composed of a compressor, a condenser, an expansion device, and an evaporator. A heat exchanger can be installed in a vehicle, a refrigerator, an air conditioner, or the like, and can make a refrigerant exchange heat with air.

A heat exchanger can be classified into a fin tube type heat exchanger, a micro channel type heat exchanger, etc. A heat exchanger may include tubes through which a refrigerant flows and a header that is connected to the tubes and distributes a refrigerant to the tubes. In the fin tube type heat exchanger, fins for heat dissipation may be coupled between the tubes.

In the related art, an inlet is formed on a side of a header through slotting or wire cutting and then a tube is inserted into the inlet. For example, a header having a plurality of insertion holes in which ends of tubes are inserted has been disclosed in Korean Patent No. 10-0644135 in the related art.

However, in the related art, there is a problem that since slotting should be performed on one header by the number of tubes, the manufacturing speed is decreased and the efficiency in mass production is deteriorated.

Further, in the related art, there is a problem that specific molds for manufacturing heat exchangers are needed in accordance with the sizes of the heat exchangers, so the manufacturing efficiency is deteriorated.

Further, in the related art, when components are coupled through brazing, there is a problem that brazing apertures may be generated by tolerance of machining equipment or tolerance between an inlet and a tube.

Further, in the related art, there is a problem that since the blade of the machining equipment becomes worn out, it is difficult to form an inlet, in which a tube is inserted, in a predetermined shape and the blade should be frequently replaced.

Korean Patent No. 10-0644135 (publication date, 2006, Nov. 10)

Korean Utility Model Publication No. 20-2007-0017024 (publication date, 2009, Apr. 27)

Korean Utility Model No. 20-0432601 (publication date, 2006, Dec. 5)

Korean Patent No. 10-1447072 (publication date, 2014, Oct. 6)

Korean Patent Application Publication No. 10-2019-0097632 (publication date, 2019, Aug. 21)

SUMMARY OF THE DISCLOSURE

An objective of the present disclosure is to solve the problems described above.

Another objective of the present disclosure is to provide a heat exchanger that can improve the efficiency in mass production by improving the manufacturing speed and the manufacturing cost.

Another objective of the present disclosure is to provide a heat exchanger the can be flexibly custom-made in accordance with a product having the heat exchanger without a specific mold.

Another objective of the present disclosure is to provide a heat exchanger that can reduce tolerance due to brazing and can improve stability of a product.

Another objective of the present disclosure is to provide an inlet in which a tube is inserted without separate slotting or wire cutting.

The objects of the present disclosure are not limited to the objects described above and other objects will be clearly understood by those skilled in the art from the following description.

In order to achieve the objectives, a heat exchanger according to an embodiment of the present disclosure may include: a plurality of tube panels including a tube elongated in one direction; a pair of header modules coupled to both ends of the plurality of tube panels; and a pair of header cases having an open side, providing a space therein, and having the header module inserted in the space such that the tube panels communicate with the spaces. The header modules may be composed of a plurality of header blocks stacked and coupled to each other, and an insertion hole in which the tube panel is inserted may be formed at each of the plurality of header blocks.

Accordingly, a heat exchanger can be flexibly custom-made in accordance with a product having the heat exchanger without a specific mold, and it is possible to increase efficiency in mass production by improving the manufacturing sped and manufacturing cost.

The insertion hole of the header blocks may be elongated in a direction in which the tube panel is elongated.

Accordingly, the contact area between the tube panel and the header block can be increased, tolerance due to brazing can be reduced, and stability of a product can be increased.

The header block may include an upper coupling block and a lower coupling block that form the insertion hole by being combined with each other with the tube panel therebetween.

Accordingly, it is possible to provide an inlet in which a tube is inserted without separate slotting or wire cutting, and it is possible to increase efficiency in mass production by improving the manufacturing sped and manufacturing cost.

The tube panel may be configured such that a fin is formed by coupling flat portions and a tube hole is formed by coupling an upper panel and a lower panel, each of which has the flat portion and the recession, a bottom of the upper coupling block is formed in a shape corresponding to a shape of the upper panel and is in contact with the upper panel, and a top of the lower coupling block is formed in a shape corresponding to a shape of the lower panel and is in contact with the lower panel.

The upper coupling block may include a first coupling groove recessed upward from a bottom of the upper coupling block at both ends of the upper coupling block, and the lower coupling block may include a first coupling protrusion protruding upward from a top of the lower coupling block at both ends of the lower coupling block and inserted in the first coupling groove.

Accordingly, it is possible to form a uniform shape by coupling the upper coupling block and the lower coupling block at a predetermined position.

The heat exchanger may include a spacer disposed at both ends of the header block between the upper coupling block and the lower coupling block, and spacing the upper coupling block and the lower coupling block by a thickness of the tube panel.

Accordingly, it is possible to secure a width of the insertion hole by the thickness of the tube panel.

The spacer may protrude from at least any one of the upper coupling block and the lower coupling block.

The spacer may include: an upper spacer protruding downward from the bottom of the upper coupling block; and a lower spacer protruding upward from the top of the lower coupling block and being in contact with the upper spacer, and the header block may include: a first coupling groove recessed upward from the upper spacer; and a first coupling protrusion protruding upward from the lower spacer and inserted in the first coupling groove.

The upper coupling block may include a second coupling protrusion protruding upward from a top of the upper coupling block, the lower coupling block may include a second coupling groove recessed upward from a bottom of the lower coupling block, and the second coupling protrusion of any one of the plurality of header blocks may be inserted in the second coupling groove of another one of the plurality of header blocks.

The plurality of header blocks each may include: a second coupling protrusion protruding upward from a top of the header block; and a second coupling groove recessed upward from a bottom of the header block, and the second coupling protrusion of any one of the plurality of header blocks may be inserted in the second coupling groove of another one of the plurality of header blocks.

The header case may include: a case groove that is recessed on a top of the header case to face the space and in which the second coupling protrusion positioned at an upper end of the header module is inserted; and an insertion block that protrudes to the space from a bottom of the header case and that is inserted in the second coupling groove positioned at a lower end of the header module.

The case groove may be elongated rearward from a front end of the header case.

Accordingly, insertion of the second coupling protrusion can be guided in a sliding type.

The heard case may include a cap block inserted from a front end of the case groove, guided toward the second coupling protrusion inserted in the case groove by the case groove, and being in contact with a surface of the second coupling protrusion.

The header case may include a slit formed by opening another surface of the header case to be able to be connected with the second coupling groove, and the insertion block may be inserted in the second coupling groove through the slit from the outside.

The header case may include a rib disposed adjacent to both sides of the header case in the header case, protruding forward from a rear surface of the header case, and limiting an insertion depth of the header module in contact with the header module.

The rib may be elongated in an up-down direction and may be in contact with the plurality of header blocks.

The heat exchanger may further include a pressing screw fastened in a nut hole formed on a top and/or a bottom of the heard case, and pressing the header module inserted in the space in an up-down direction by being rotated in one direction.

Accordingly, there is an advantage that it is possible to reduce tolerance between the header block and the tube panel by pressing the header block.

The tube panel may be divided into a plurality of fins and a plurality of tubes formed between and the plurality of fins, and the pressing screw may be disposed at positions corresponding to positions of the plurality of fins.

The header case may have an opening formed at a top of the header case and may include a cover block inserted in the opening and having a groove fitted to a second coupling protrusion of a header module inserted in the header case.

In order the achieve the objectives, a heat exchanger according to another embodiment of the present disclosure includes: a plurality of tube panels including a tube elongated in one direction; a header module coupled to an end of the plurality of tube panels; and a pair of header cases having an open side, providing a space therein, and having the header module inserted in the space such that the tubes communicate with the spaces, in which the header modules is composed of a plurality of header blocks stacked and coupled to each other, and an insertion hole in which the tube panel is inserted is formed at each of the plurality of header blocks.

In order the achieve the objectives, a heat exchanger according to another embodiment of the present disclosure includes: a plurality of tube panels including a tube elongated in one direction; a pair of header modules coupled to both ends of the plurality of tube panels; and a pair of header cases having an open side, providing a space therein, and having the pair of header modules inserted in the spaces, respectively, such that the tubes communicate with the spaces, in which the pair of header modules are each composed of a plurality of header blocks stacked and coupled to each other, an insertion hole in which the tube panel is inserted is formed at each of the plurality of header blocks, the plurality of header blocks each include an upper coupling block and a lower coupling block that form the insertion hole by being combined with each other with the tube panel therebetween, a bottom of the upper coupling block is formed in a shape corresponding to a shape of a top of the tube panel and is in contact with the upper panel, and a top of the lower panel is formed in a shape corresponding to a shape of a bottom of the tube panel and is in contact with the lower panel.

In order the achieve the objectives, a method of manufacturing a heat exchanger includes: inserting a tube panel between insertion holes formed in a header block; forming a header block by stacking a plurality of header blocks inserted in the tube panel; inserting the header block in a space of a header case; and brazing a heat exchanger including the header module and the header case.

The step of inserting of a tube panel between insertion holes may be to assemble a first coupling block and a second coupling block up and down with the tube panel therebetween.

The forming of a header block may include inserting a coupling protrusion formed at any one of the plurality of header blocks in a coupling groove formed at another one of the plurality of header blocks.

The details of other exemplary embodiments are included in the following detailed description and the accompanying drawings.

According to the heat exchanger and the method of manufacturing a heat exchanger of the present disclosure, one or more of the following effects can be achieved.

First, there is an advantage that the manufacturing speed and manufacturing cost are improved, whereby it is possible to increase the efficiency of mass production.

Second, there is an advantage that it is possible to manufacture a heat exchanger flexibly in a custom-made type in correspondence to the size of a product having the heat exchanger without a specific mold.

Third, there is an advantage that it is possible to reduce tolerance due to brazing and increase stability of a product.

Fourth, there is an advantage that it is possible to provide a structure in which a tube in inserted without separate slotting or wire cutting.

The effects of the present disclosure are not limited to those described above and other effects not stated herein may be made apparent to those skilled in the art from claims.

BRIEF DESCRIPTION OF THE DRAWINGS

FIG. 9 shows the state in which a plurality of header blocks 20*a*, 20*b*, 20*c*, . . . are separated and FIG. 10 shows the state in which a plurality of header blocks 20*a*, 20*b*, 20*c*, . . . are combined.

FIG. 13 shows a cap block 327 and a pressing screw 36 separated from the header case 30.

FIG. 15 shows an insertion block 337 separated from the header case 30.

DESCRIPTION OF EXEMPLARY EMBODIMENTS

Figure 1:
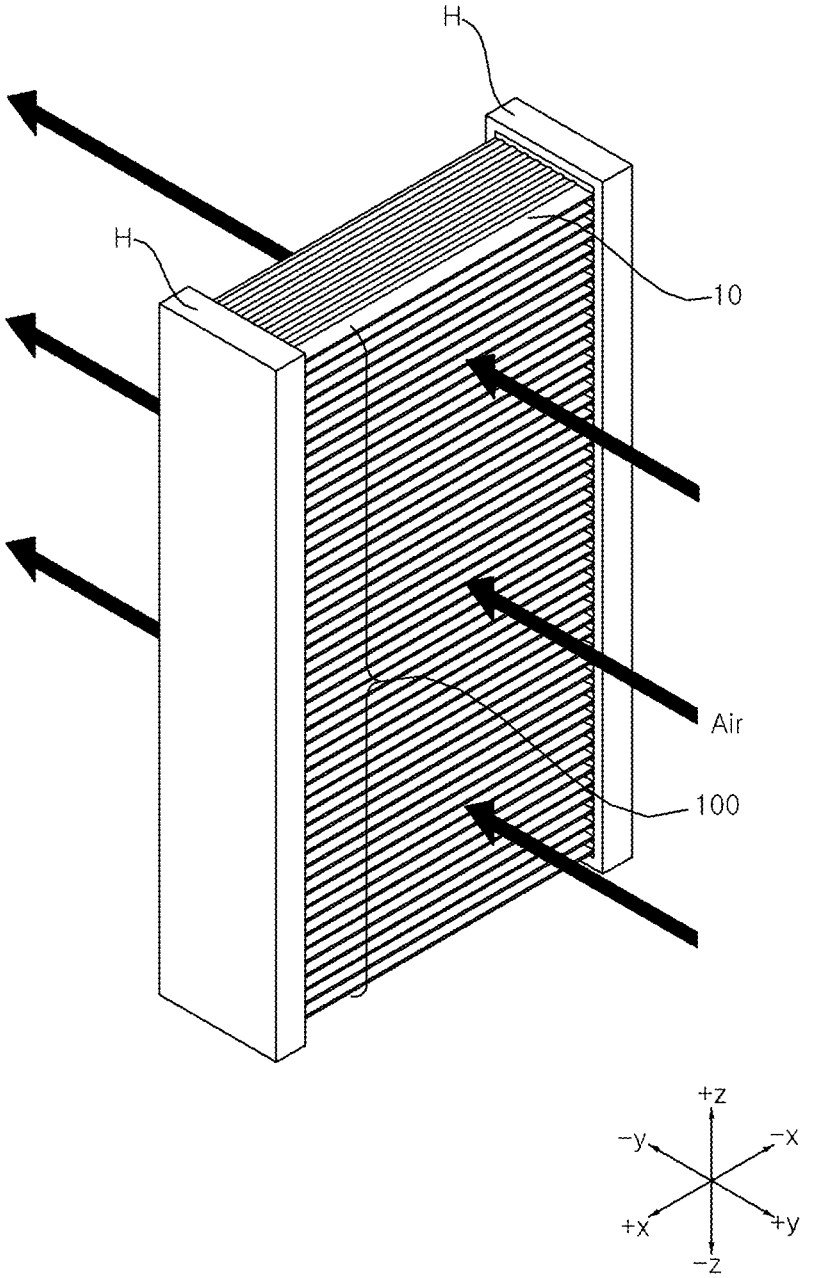
FIG. 1 is a view of a heat exchanger according to an embodiment of the present disclosure.

The advantages and features of the present disclosure, and methods of achieving them will be clear by referring to the exemplary embodiments that will be describe hereafter in detail with reference to the accompanying drawings. However, the present disclosure is not limited to the exemplary embodiments described hereafter and may be implemented in various ways, and the exemplary embodiments are provided to complete the description of the present disclosure and let those skilled in the art completely know the scope of the present disclosure and the present disclosure is defined by claims. Like reference numerals indicate like components throughout the specification.

Spatial relative terms "below", "beneath", "lower", "above", "upper", etc. may be used to easily describe the correlation of one component and another component, as shown in the drawings. The spatially relative terms should be construed as terminologies including different directions of components in using or in operating in addition to the directions shown in drawings. For example, when components shown in the drawings are turned upside down, a component described as being "below" or "beneath" another component may be positioned "over" the another component. Accordingly, "below" and "beneath" that are exemplary terms may include both of up and down directions. A component may be oriented in different directions, so the spatially relative terms may be construed in accordance with orientation.

The terms used herein are provided to describe embodiments without limiting the present disclosure. In the specification, a singular form includes a plural form unless specifically stated in the sentences. The terms "comprise" and/or "comprising" used herein do not exclude that another component, step, and/or operation exist or are added in the stated component, step, and/or operation.

Unless defined otherwise, all terms (including technological and scientific terminologies) used herein may be used as meanings that those skilled in the art can commonly understand. Terms defined in common dictionaries are not construed ideally or excessively unless specifically clearly defined.

The thickness or size of components is exaggerated, omitted, or schematically shown in the drawings for convenience and clarity of description. The size or area of components does not generally reflect the actual size or area Hereinafter, the present disclosure will be described with reference to the drawings illustrating a heat exchanger according to exemplary embodiments of the present disclosure.

Hereafter, directions are defined with respect the a heat exchanger according to an embodiment of the present disclosure and components thereof on the basis of the coordinate system shown in FIGS. 1 to 19.

The directions in which the x-axis extends may be defined as front/rear directions. The direction in which the +x-axis extends from the origin may be the front direction and the direction in which the −x-axis extends from the origin may be the rear direction. The directions in which the y-axis extends may be defined as left/right directions. The direction in which the +y-axis extends from the origin may be the right direction and the direction in which the −y-axis extends from the origin may be the left direction. The directions in which the z-axis extends may be defined as up/down directions. The direction in which the +z-axis extends may be the up direction and the direction in which the −z-axis extends may be the down direction.

Referring to FIGS. 1 to 19, all the portions that are inserted, coupled, fitted, contacted, bonded, and assembled of the components of a heat exchanger may be combined by brazing. A filler material may be applied to all the portions that are inserted, coupled, fitted, contacted, bonded, and assembled of the components of a heat exchanger. A heat exchanger is put in a furnace with a filer material applied and exposed at a high temperature for a predetermined time, whereby it can be brazed. Brazing may not be described in the following description.

Referring to FIG. 1, a heat exchanger according to the present disclosure may include a tube panel 10. The tube panel 10 may be elongated in the front-rear direction. A plurality of fins 102 and a plurality of tubes 103 are integrally formed, thereby being able to configure the tube panel 10 (see FIG. 5). A plurality of tube panels 10 may be provided, whereby a tube panel module 100 may be configured.

The heat exchanger according to the present disclosure includes a header H. The header H may be coupled to an end of the tube panel 10. The header H may be provided in a pair and coupled to both ends of the tube panel 10, respectively. The headers H may be elongated in the up-down direction. A plurality of tube panels 10 may be spaced apart from each other and arranged in the longitudinal direction of the headers H.

A refrigerant may flow into any one of the pair of headers H. The refrigerant flowing inside can pass through the tubes of the tube panel 10. The refrigerant that has passed through the tubes can flow into the other one of the pair of headers H and then can be discharged out of the heat exchanger. Air can exchange heat with the refrigerant while passing through between a plurality of tube panels 10.

Figure 2:
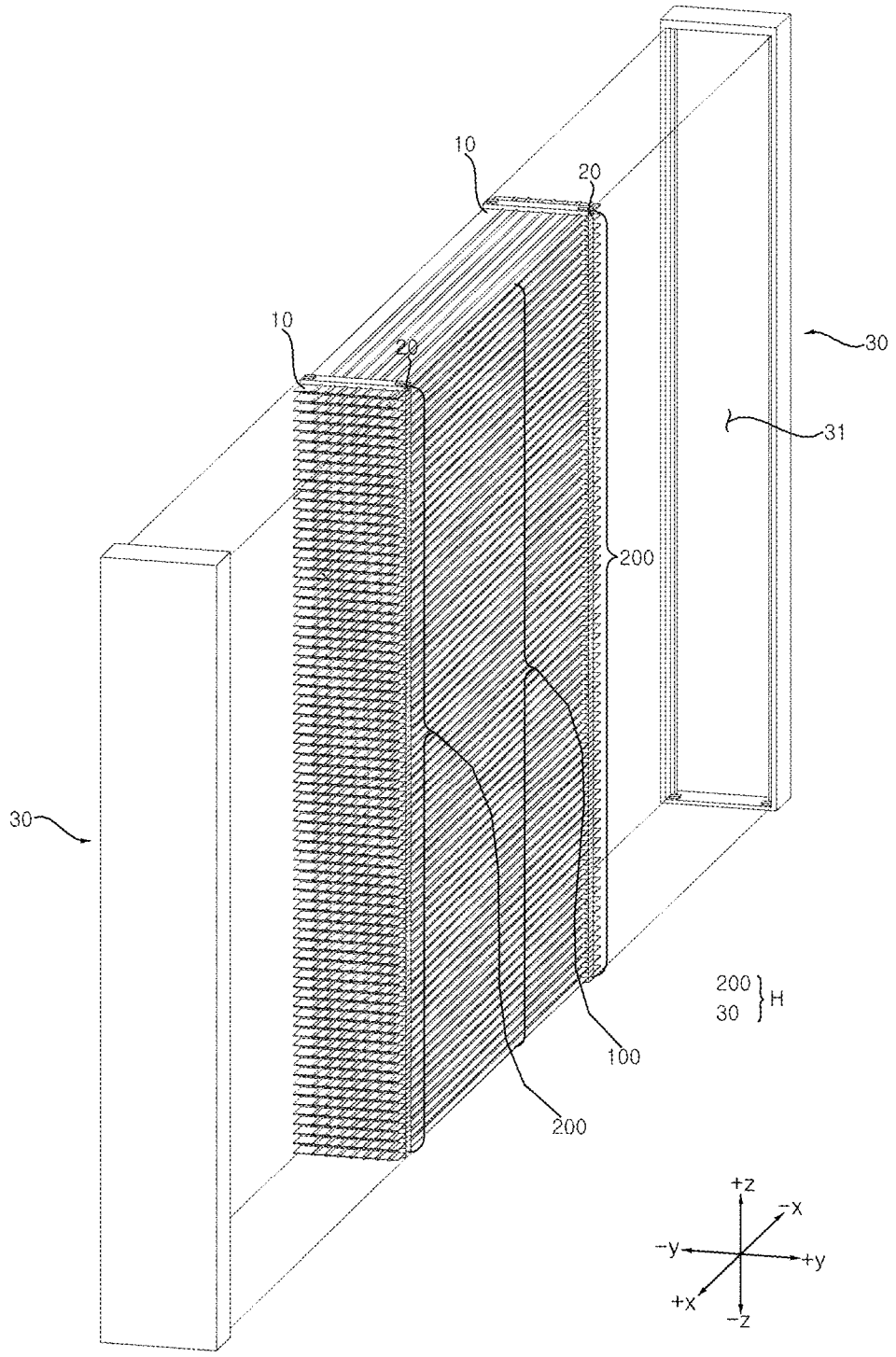
FIG. 2 is a view about the header H and the tube panel 10 shown in FIG. 1.

Referring to FIG. 2, the header H may include a header module 200 and a header case 30. The header H may be configured by inserting the header module 200 in the header case 30. The header case 30 may be open on the front surface so that the header module 200 is inserted, and may provide a space 31 therein. The header module 200 may be coupled to ends of the plurality of tube panels 10. The header module 200 may be provided in a pair and may be coupled to both ends of the plurality of tube panels 10. When the header module 200 is inserted in the space 31, the plurality of tube panels 10 coupled to the header module 200 may communicate with the space 31.

Figure 3:
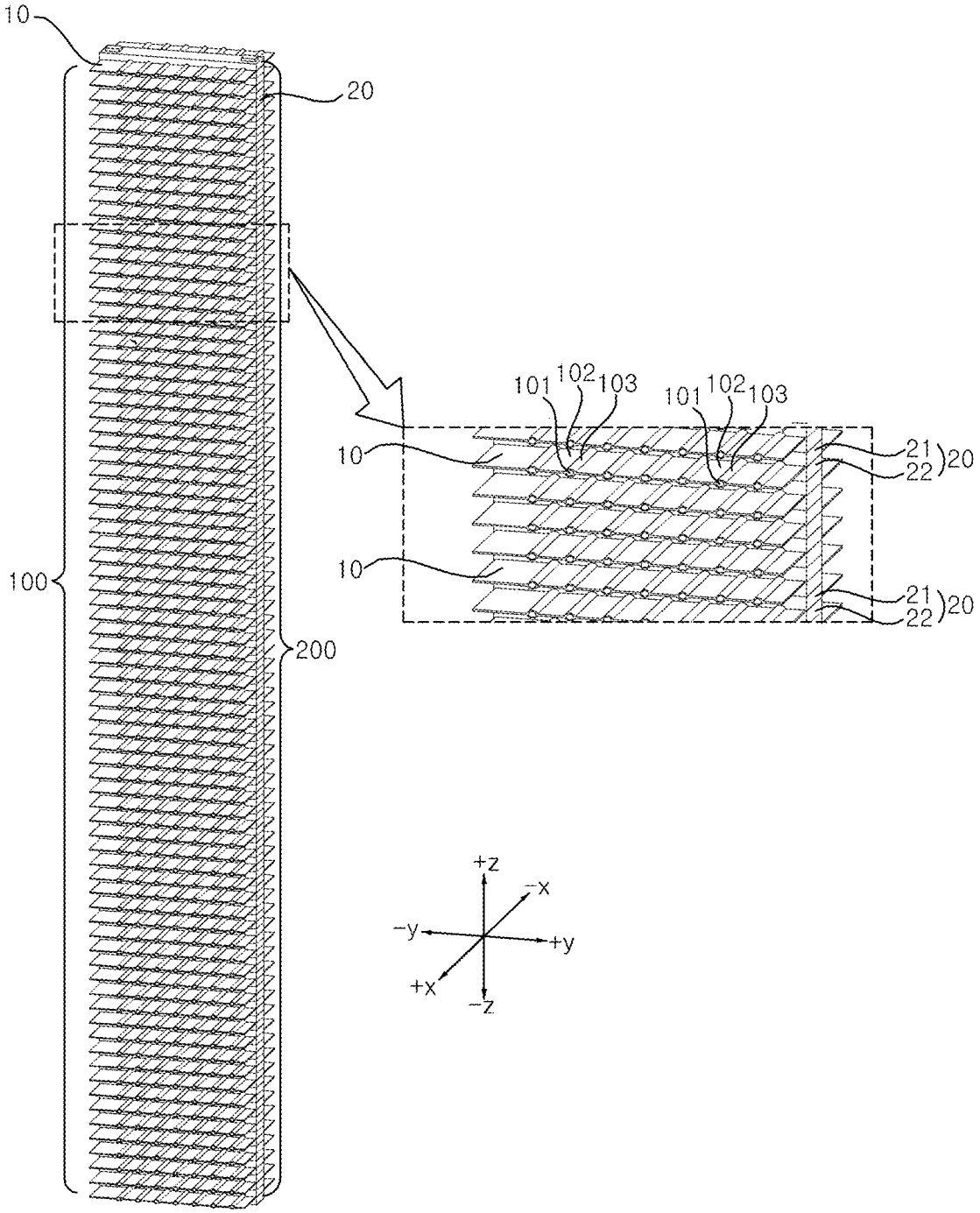
FIG. 3 is a view about a header module 200 included in the header H shown in FIG. 2 and a plurality of tube panels 10 inserted therein.

Hereafter, referring to FIG. 3, the header module 200 may be formed by stacking a plurality of header blocks 20 in the up-down direction. An end of the tube panel 10 may be inserted in the header block 20. Both ends of the tube panel 10 may be inserted in a pair of header blocks 20, respectively. One header block 20 may be combined with one tube panel 10. A plurality of tube panels 10 may be inserted in a plurality of header blocks 20, respectively. A plurality of tube panels 10 may be stacked in the up-down direction in which a plurality of header blocks 20 are stacked. The header cases 30 may be elongated in the up-down direction in which a plurality of header blocks 20 are stacked.

A refrigerant may flow into any one of the pair of header cases 30. The refrigerant flowing in the header case 30 may pass through the tube panels 10 inserted in the header module 200. The refrigerant that has passed through the tube panels 10 may flow into the header 30 at the opposite side and then may be discharged out of the header case 30.

Figure 4:
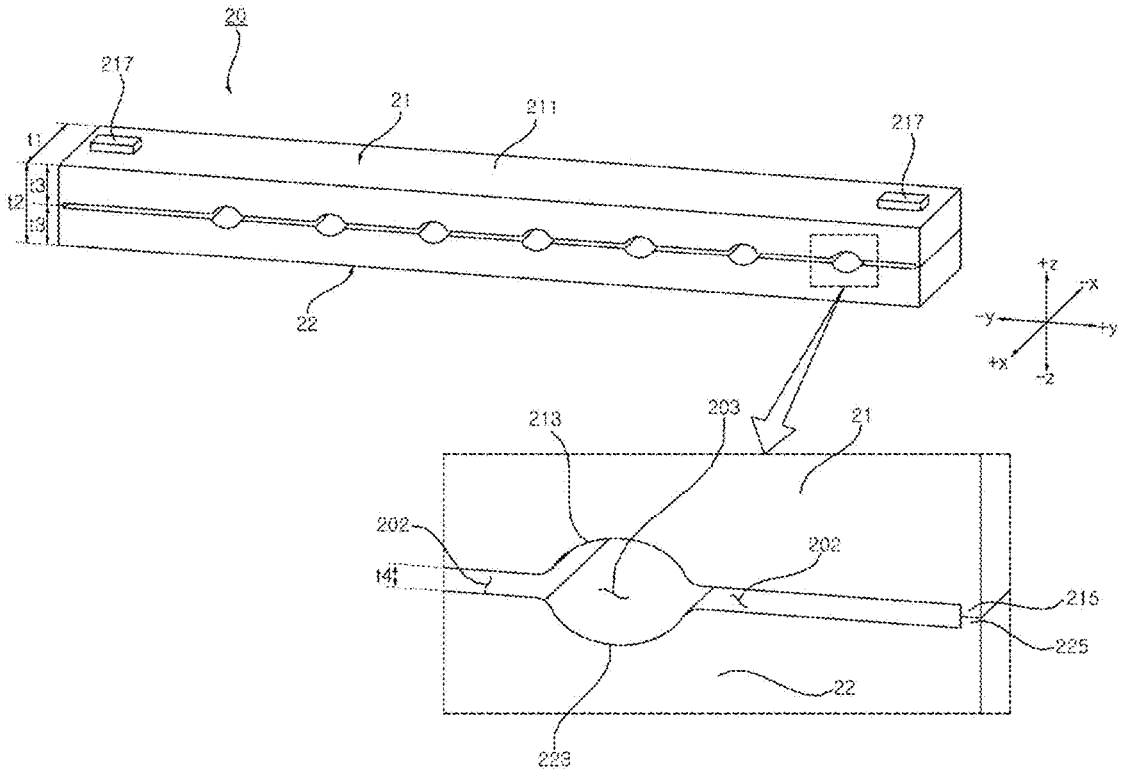
FIG. 4 is a view about any one of a plurality of header blocks 20 constituting the header module 200.

Hereafter, referring to FIG. 4, an insertion hole 202, 203 may be formed in the header block 20. The tube panel 10 may be inserted in the insertion hole 202, 203.

The tube panel 10 may be composed of a plurality of fins 102 and a plurality of tubes 103. The plurality of fins 102 and the plurality of tubes 103 may be alternately arranged. The plurality of fins 102 and the plurality of tubes 103 may be arranged in the left-right direction.

The insertion hole 202, 203 may have a shape corresponding to the tube panel 10 and the tube panel 10 may be inserted in close contact with the surfaces forming the insertion hole 202, 203. The tube panel 10 may pass through the insertion hole 202, 203.

The insertion hole 202, 203 may include fin insertion holes 202 having a shape corresponding to the shape of the fins 102. The fin insertion holes 202 may have a width corresponding to the thickness of the fins 102. The fin insertion holes 202 may have a slit shape. The insertion hole 202, 203 may include tube insertion holes 203 corresponding to the shape of the tubes 103. The tube insertion holes 203 may have various shapes such as a circle, an ellipse, or a rectangle. The fin insertion holes 202 and the tube insertion holes 203 may be provided as several pieces and may be arranged alternately in the left-right direction. The fin insertion holes 202 and the tube insertion holes 203 may be continuously formed.

The plurality of fins 102 may be inserted in the plurality of fin insertion holes 202. The plurality of tubes 103 may be inserted in the plurality of tube insertion holes 203.

The header block 20 may include an upper coupling block 21 and a lower coupling block 22. The upper coupling block 21 and the lower coupling block 22 are combined with the tube panel 10 therebetween, thereby being able to for, the insertion hole 202, 203. The bottom of the upper coupling block 21 may come in contact with a surface of the tube panel 10 and the top of the lower coupling block 22 may come in contact with another surface of the tube panel 10.

The header block 20 may be elongated in the left-right direction in which the plurality of fins 102 and tubes 103 are arranged. The header block 20 may be elongated in the front-rear direction in which the tube panel 10 is elongated. The length t1 of the header block 20 elongated in the front-rear direction may be similar to the height t2 in the up-down direction of the header block 20. The length t1 of the upper coupling block 21 and the lower coupling block 22 that are elongated in the front-rear direction may be larger than the height t3 of the upper coupling block 21 of the lower coupling block 22. The insertion hole 202, 203 may be elongated in the header block 20 in the front-rear direction in which the tube panel 10 is elongated.

Accordingly, the contact area between the tube panel 10 and the header block 20 through the insertion hole 202, 203 may be increased. The center portion of the header block 20 is bent down and presses the tube panel 10 inserted in the insertion hole 202, 203, whereby the coupling force can be increased and apertures can be reduced in brazing.

Spacer 215 and 225 may be disposed between the upper coupling block 21 and the lower coupling block 22. The spacers 215 and 225 may be disposed at both ends of the header block 20. The spacers 215 and 225 can space the upper coupling block 21 and the lower coupling block 22 from each other by the thickness t4 of the tube panel 10. The insertion hole 202, 203 may be defined by being surrounded by the bottom of the upper coupling block 21, the top of the lower coupling block 22, and the spacers 215 and 225.

Figure 5:
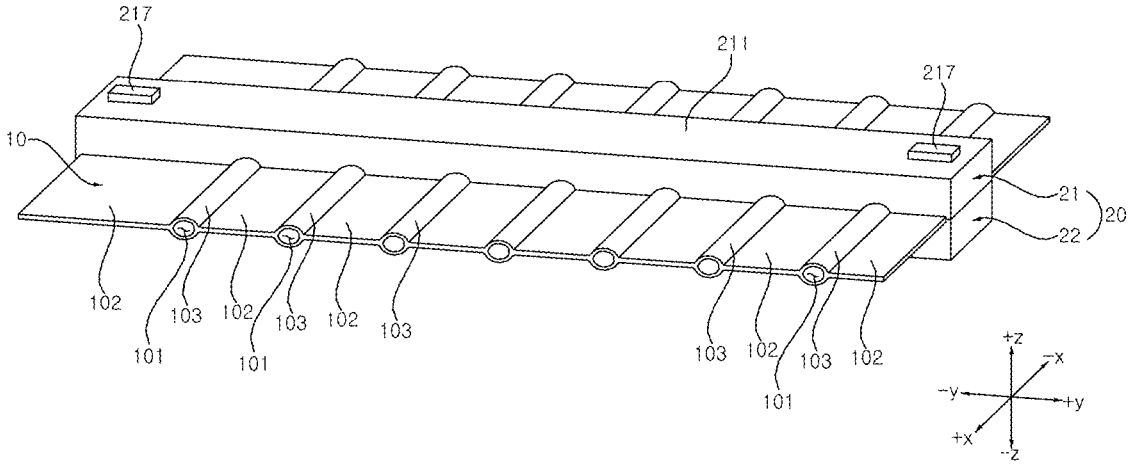
FIG. 5 is a view about a header block 20 in which a tube panel 10 is inserted.
Figure 6:
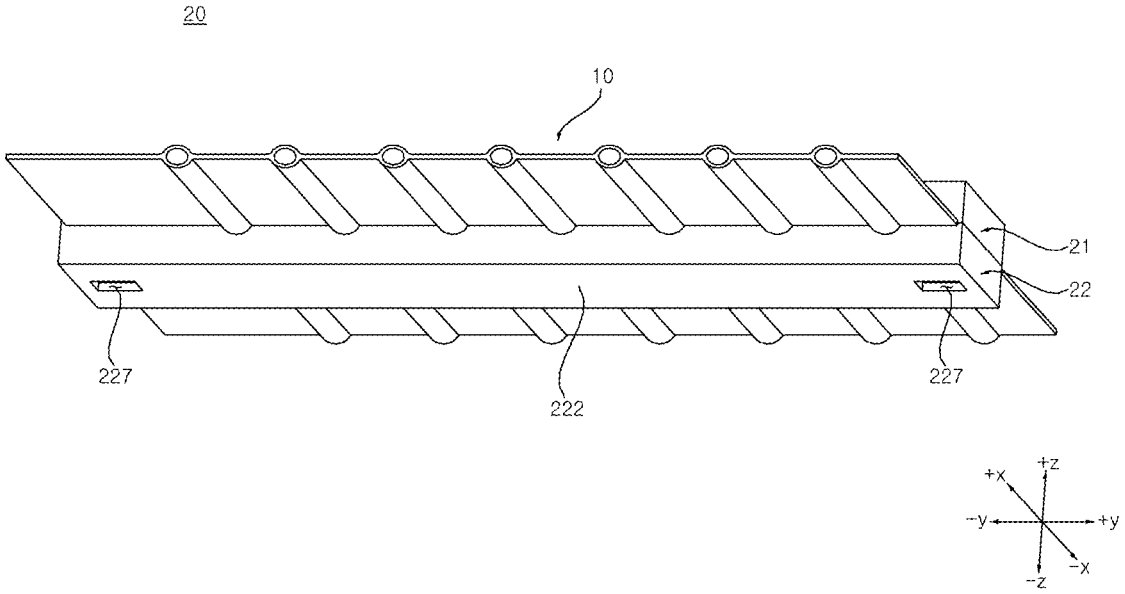
FIG. 6 is a view showing the header block 20 of FIG. 5 in another direction.

Hereafter, referring to FIGS. 5 and 6, the header block 20 may include a second coupling protrusion 217 protruding upward from the top of the header block 20. The header block 20 may include a second coupling groove 227 recessed upward from the bottom of the header block 20. The second coupling groove 227 may be recessed in a shape corresponding to the second coupling protrusion 217. The second coupling protrusion 217 and the second coupling groove 227 may be positioned at positions corresponding to each other. The second coupling protrusion 217 may be inserted in the second coupling groove 227.

The second coupling protrusion 217 may protrude upward from the top of the upper coupling block 21. The second coupling groove 227 may be recessed upward from the bottom of the lower coupling block 22.

The second coupling protrusion 217 and the second coupling groove 227 may be formed as several pieces symmetrically at two sides on the top of the header block 20.

Accordingly, the upper coupling block 21 and the lower coupling block 22 may be disposed at 180 degrees with respect to each other, and the second coupling protrusions 217 may be inserted in the second coupling grooves 227.

The second coupling protrusions 217 and the second coupling grooves 227 may be formed in various shapes.

Figure 7:
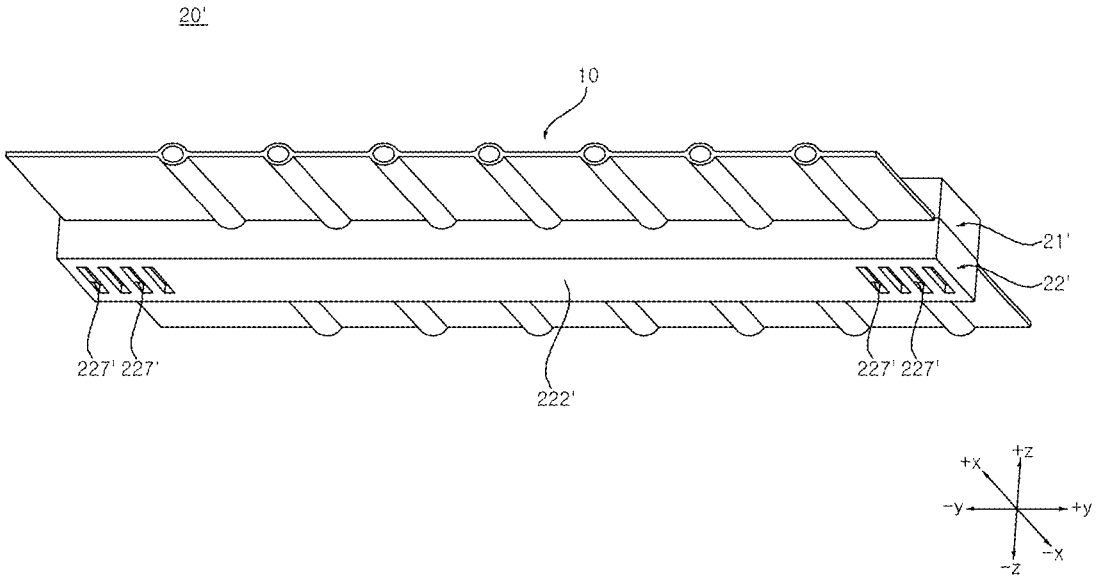
FIG. 7 is a view about a header block 20' according to another embodiment.

For example, referring to FIG. 7, a second coupling groove 227' may have a shape that is long in the front-rear direction. The second coupling grooves 227' may be provided at four positions at the left and right sides, respectively, on a header block 20'.

Figure 8:
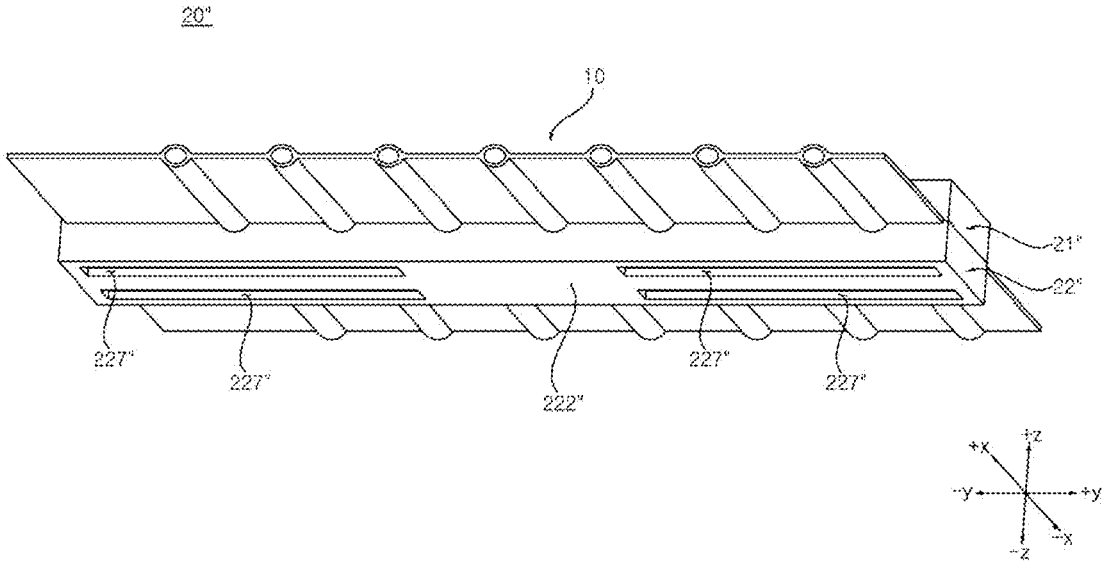
FIG. 8 is a view about a header block 20" according to another embodiment.

As another example, referring to FIG. 8, a second coupling groove 227" may have a shape that is long in the left-right direction. The second coupling groove 227" may be provided at four positions at the right side and two positions at the right side on a header block 20". These are only examples, and the shapes, numbers, and arrangement of the second coupling protrusion 217 and the second coupling grooves 227 may be variously changed. The shapes and sizes of the second coupling protrusion 217 and the second coupling grooves 227 may depend on the size of the entire heat exchanger.

Figure 9:
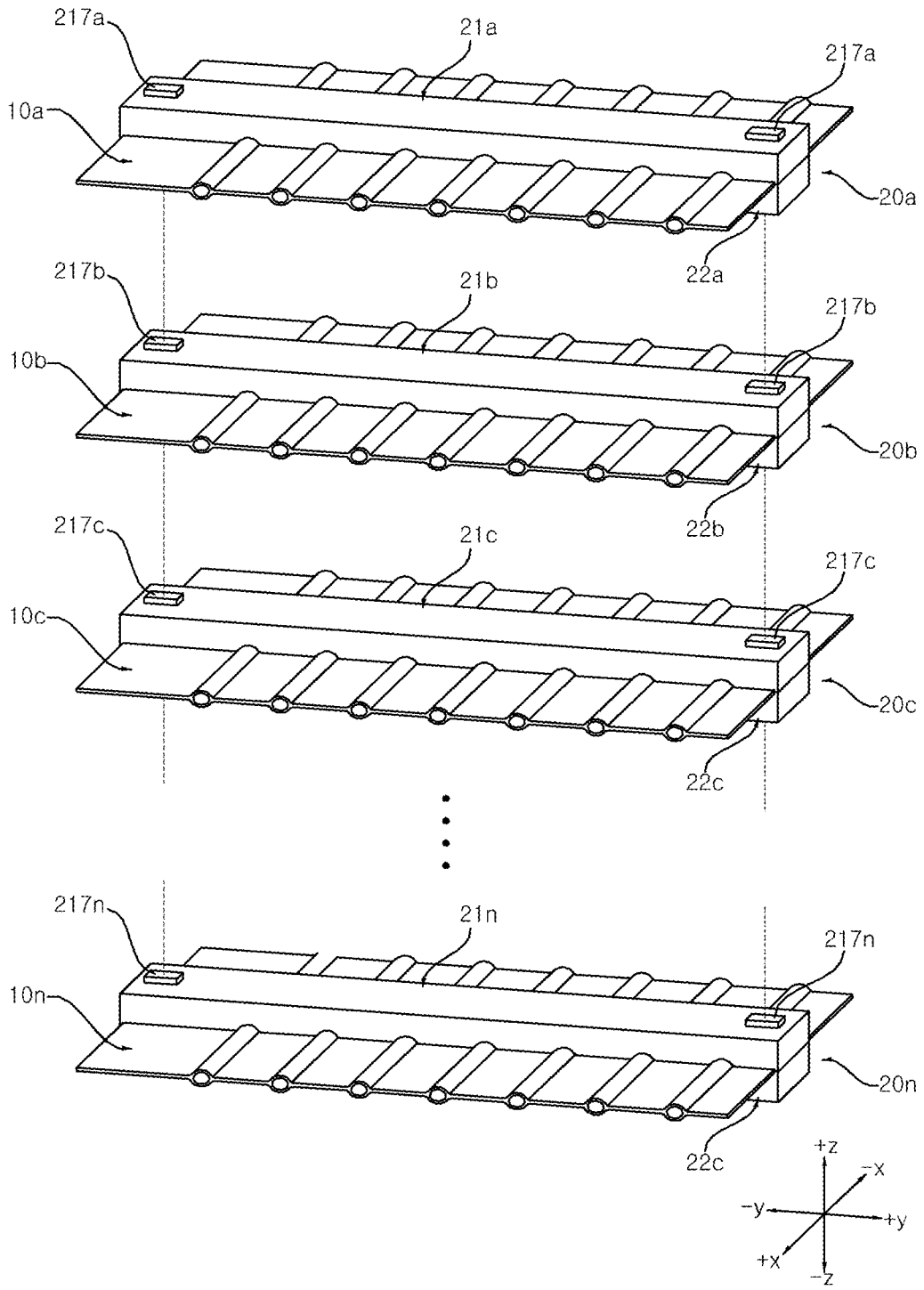
FIGS. 9 and 10 are views showing that a plurality of header blocks 20*a*, 20*b*, 20*c*, . . . are coupled. In detail.
Figure 10:
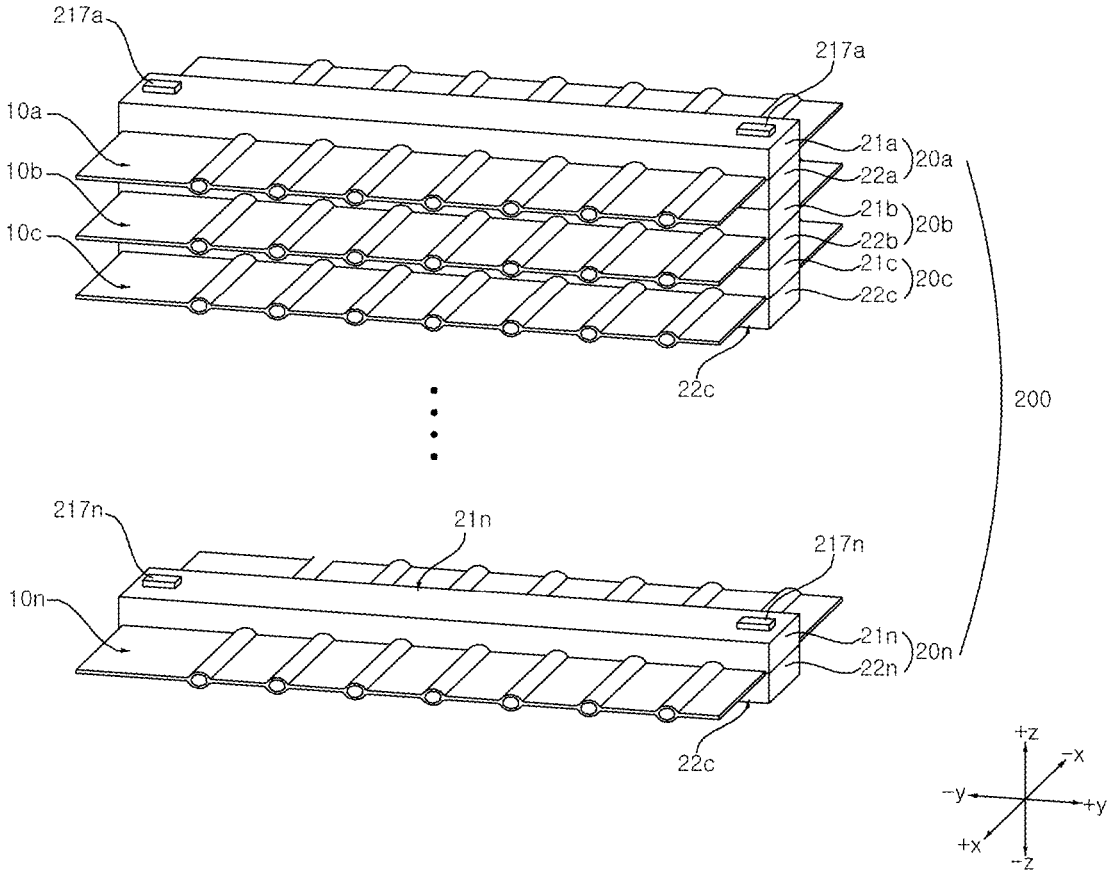

Referring to FIGS. 9 and 10, any one of the plurality of header blocks 20 may be combined with another one of the plurality of header blocks 20. The second coupling protrusion 217 of any one of the plurality of header blocks 20 may be inserted in the second coupling groove 227 of another one of the plurality of header blocks 20.

For example, a first header block 20*a* may be coupled to the top of a second header block 20*b*. The second header block 20*b* may be coupled to the top of a third header block 20*c*. In this case, the second coupling protrusion 217*b* formed on the top of the second header block 20*b* may be inserted in the second coupling groove 227*a* (see 227 in FIG. 6) formed on the bottom of the first header block 20*a*. The second coupling protrusion 217*c* formed on the top of the third header block 20*c* may be inserted in the second coupling groove 227*b* (see 227 in FIG. 6) formed on the bottom of the second header block 20*b*. Through this process, the header module 20 may be formed by stacking a plurality of header blocks 20*a*, 20*b*, 20*c*, . . . , and 20*n*. The number of the header blocks 20 to be stacked is not limited and may depend on the specification of a product.

A filer material may be applied between the plurality of header blocks 20 combined with each other. The filer material may be applied between the second coupling protrusion 217 and the second coupling groove 227 and between the top of the upper coupling block 21 and the bottom of the lower coupling block. The plurality of header blocks 20 may be combined with each other by brazing.

Accordingly, the plurality of header blocks 20 can be stacked and coupled to each other in the up-down direction. As the plurality of header blocks 20 are stacked in the up-down direction, the header module 20 can be formed and a plurality of tube panels 20 can be arranged in the up-down direction. The header blocks 20 may be manufactured in the same specification, the manufacturing cost can be reduced. It is possible to change the sizes and specifications of the header module 200 and the header H by changing only the number of the header blocks 20 that have the same specification and are stacked, so there is an advantage that it is possible to easily cope with a change of the size of a product.

Figure 11:
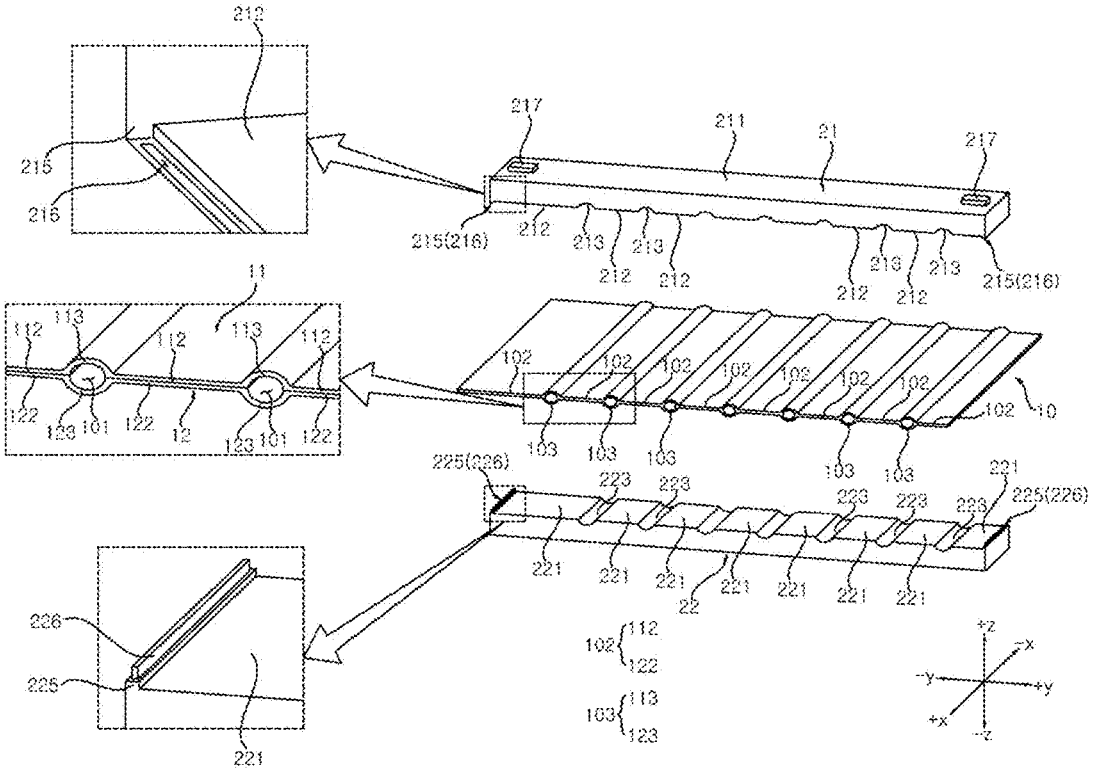
FIG. 11 is an exploded view showing a header block 20 in which a tube block 10 is inserted.

Referring to FIG. 11, the tube panel 10 may be divided into an upper panel 11 and a lower panel 12. The upper panel 11 and the lower panel are combined up and down with each other, whereby the fins 102 and tubes 103 of the tube panel 10 can be formed. A tube hole 101 through which a refrigerant flows may be formed in the tube 103.

The upper panel 11 may include a first flat portion 112 formed at a position corresponding to the fin 102 and a first recession 113 formed at a position corresponding to the tube 103. The first flat portion 112 and the first recession 113 may be elongated in the front-rear direction. The first flat portion 112 and the first recession 113 may be provided as several pieces and may be arranged alternately in the left-right direction.

The lower panel 12 may include a second flat portion 122 formed at a position corresponding to the fin 102 and a second recession 123 formed at a position corresponding to the tube 103. The second flat portion 122 and the second recession 123 may be elongated in the front-rear direction. The second flat portion 122 and the second recession 123 may be provided as several pieces and may be arranged alternately in the left-right direction.

The first flat portion 112 and the second flat portion 122 are coupled to face each other, whereby the fin 102 may can be formed. The first recession 113 and the second recession 123 are coupled to face each other, whereby the tube hole 101 and tube 103 can be formed therein. The fin 102 may include a first flat portion 112 and a second flat portion 122. The tube 103 may include a first recession 113 and a second recession 123.

The bottom 212 of the upper coupling block 21 may be formed in a shape corresponding to the shape of the upper panel 11. The bottom of the upper coupling block 21 may come in contact and/or close contact with the upper panel 11. The bottom of the upper coupling block 21 may form a flat surface 212 at a position corresponding to the first flat portion 112. The bottom of the upper coupling block 21 may form a recession 213 recessed upward at a position corresponding to the first recession 113.

The top 221 of the lower coupling block 22 may be formed in a shape corresponding to the shape of the lower panel 12. The top 221 of the lower coupling block 22 may come in contact and/or close contact with the lower panel 12. The top of the lower coupling block 22 may form a flat surface 21 at a position corresponding to the second flat portion 122. The top of the lower coupling block 22 may form a recession 223 recessed downward at a position corresponding to the second recession 123.

The upper coupling block 21 may include a first coupling groove 216. The first coupling groove 216 may be recessed upward from the bottom of the upper coupling block 21 at both ends of the upper coupling block 21.

The lower coupling block 22 may include a first coupling protrusion 226. The first coupling protrusion 226 may protrude upward from the top of the lower coupling block 22 at both ends of the lower coupling block 22. The first coupling protrusion 226 may be inserted in the first coupling groove 216.

A filer material may be applied to the surfaces on which the upper coupling block 21, the lower coupling block 22, and the tube panel 10 are in contact with each other. The upper coupling block 21, the lower coupling block 22, and the tube panel 10 may be coupled to each other by brazing.

The spacers 215 and 225 may be disposed at both ends of the header block 20 between the upper coupling block 21 and the lower coupling block 22. The spacers 215 and 225 can space the upper coupling block 21 and the lower coupling block 22 from each other by the thickness t4 (see FIG. 4) of the tube panel 10.

The spacers 215 and 225 may protrude from at least any one of the upper coupling block 21 and the lower coupling block 22. The spacers 215 and 225 may include an upper spacer 215 protruding downward from the bottom of the upper coupling block 21. The spacers 215 and 225 may include a lower spacer 225 protruding upward from the top of the lower coupling block 22. The lower spacer 225 can space the upper coupling block 21 and the lower coupling block 22 from each other by the thickness t4 (see FIG. 4) of the tube panel 10 by be in contact with the upper spacer 215.

The first coupling groove 216 may be formed in the upper spacer 215. The first coupling groove 216 may be recessed upward from the upper spacer 215. The width of the first coupling groove 216 may be smaller than the width of the upper spacer 215.

The first coupling protrusion 226 may protrude upward from the lower spacer 225. The width of the first coupling protrusion 226 may be smaller than the width of the lower spacer 225. The first coupling protrusion 226 may be inserted in the first coupling groove 216.

When the first coupling protrusion 226 is inserted in the first coupling groove 216, the upper spacer 215 and the lower spacer 225 can be in contact with each other to face each other.

Figure 12:
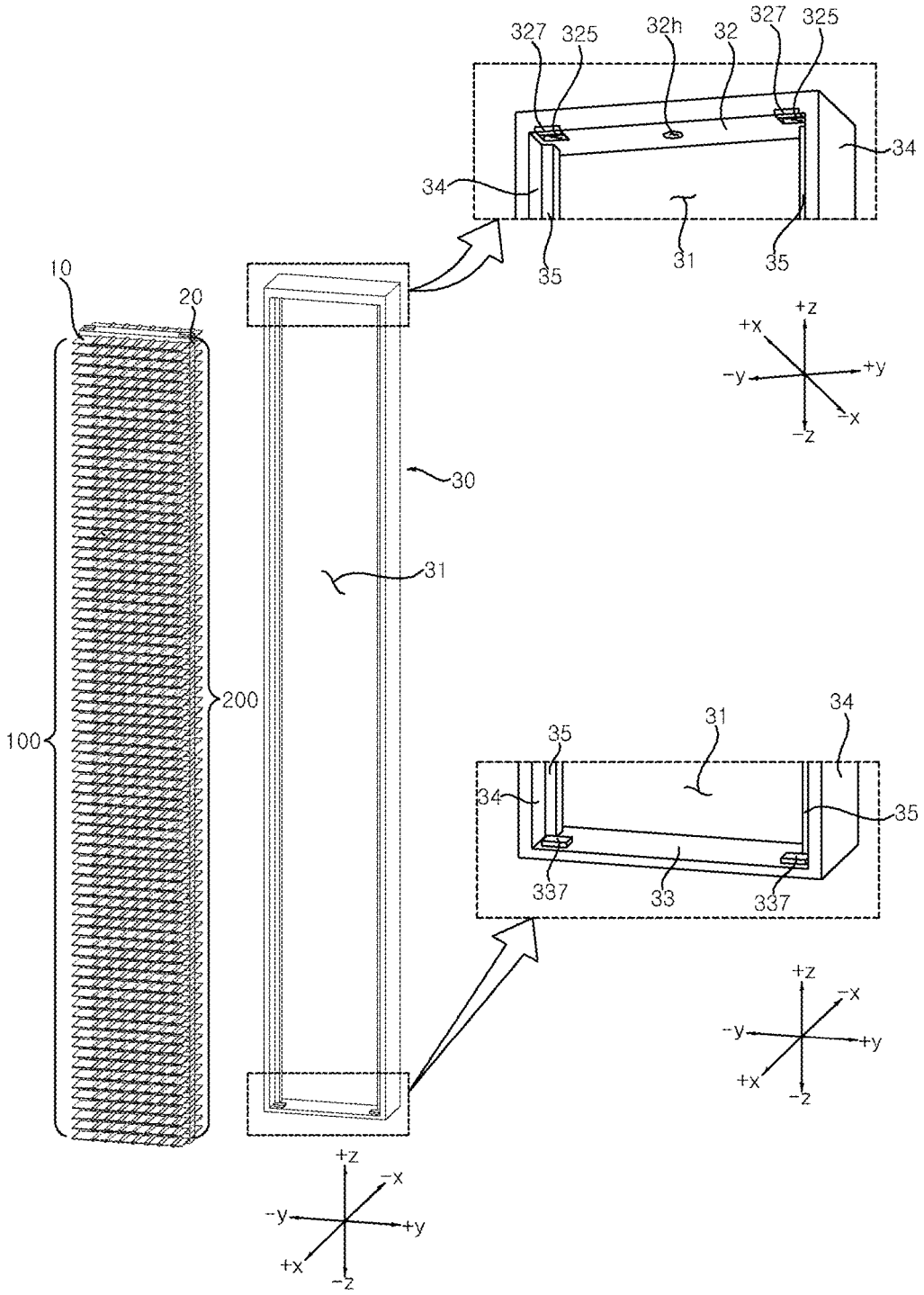
FIG. 12 is a view showing a header module 200 separated from a header case 30 according to an embodiment of the present disclosure.

Hereafter, referring to FIG. 12, the header case 30 may be open on a first side and may provide a space 31 therein. The space 31 may be surrounded by the top 32, bottom 33, both sides 34, and the rear surface (not indicated by reference numeral) of the header case 30.

The header module 200 may be inserted and/or coupled in the space 31 of the header case 30. The header module 200 can close the open first side of the header case 30 by being inserted and/or coupled in the header case 30. The header cases 30 may be elongated in the up-down direction in which the header blocks 20 are stacked.

When the header module 200 is inserted and/or coupled in the header case 30, the tube panels 10 coupled to the header module 200 can communicate with the space 31 of the header case 30.

A refrigerant may flow into the header case 30 or may be discharged from the header case 30. The heat exchanger may include a pair of header cases 30. A refrigerant flowing in any one of the pair of header cases 30 may be discharged outside through the other one of the pair of header cases 30.

The refrigerant flowing in any one header case 30 can sequentially pass through the space 31 and the tube panels 10. The refrigerant that has passed through the tube panel 10 can pass through the space 31 formed at the other one header case 30 and then can be discharged out of the header case.

The second coupling protrusion 217 may protrude upward from the upper end of the header module 200. The second coupling protrusion 217 may be the one formed at the header block 20 disposed at the upper end of the header module 200.

The second coupling groove 227 may be recessed upward from the lower end of the header module 200. The second coupling groove 227 may be the one formed at the header block 20 disposed at the lower end of the header module 200.

A case groove 325 may be formed on the inner surface of the header case 30. The case groove 325 may be recessed on the top of the header case 30 to face the space 31. The case groove 325 may have a shape corresponding to the second coupling protrusion 217. The second coupling protrusion 217 positioned at the upper end of the header module 200 may be inserted in the case groove 325.

An insertion block 337 may be formed on the inner surface of the header case 30. The insertion block 337 may protrude into the space 31 from the bottom of the header case 30. The insertion block 337 may include a shape corresponding to the second coupling groove 227. The insertion block 337 may be inserted in the second coupling groove 227 positioned at the lower end of the header module 200.

The header case 30 may include ribs 35 therein. The ribs 35 may be disposed adjacent to both sides 34 of the header case 30. The ribs 35 may protrude toward the space 31 from both sides 34 of the header case 30. The ribs 35 may be spaced rearward apart from the open first side of the header case 30, whereby a step may be formed. The ribs 35 may protrude forward from the rear surface of the header case 30. The ribs 35 may come in contact with the header module 200.

Accordingly, the ribs 35 can adjust the depth at which the header module 200 is inserted in the header case 30.

The ribs 35 may be elongated in the longitudinal direction of the header case 30. The ribs 35 may be elongated in the up-down direction. The ribs 35 may be elongated in the direction in which the header blocks 20 are stacked. The ribs 35 may come in contact with a plurality of header blocks 20. The ribs 35 may come in contact with a plurality of tube panels 10.

Accordingly, the ribs 35 can uniformly adjust the depth at which the plurality of header blocks 20 are inserted in the header case 30.

Accordingly, the ribs 35 space the plurality of tube panels 10, which protrude rearward from the header blocks 20 through the insertion holes 202, 203, forward from the header blocks 20, thereby being able to prevent the tube panels 10 from protruding rearward from the header blocks and to align the tube panels 10.

Figure 13:
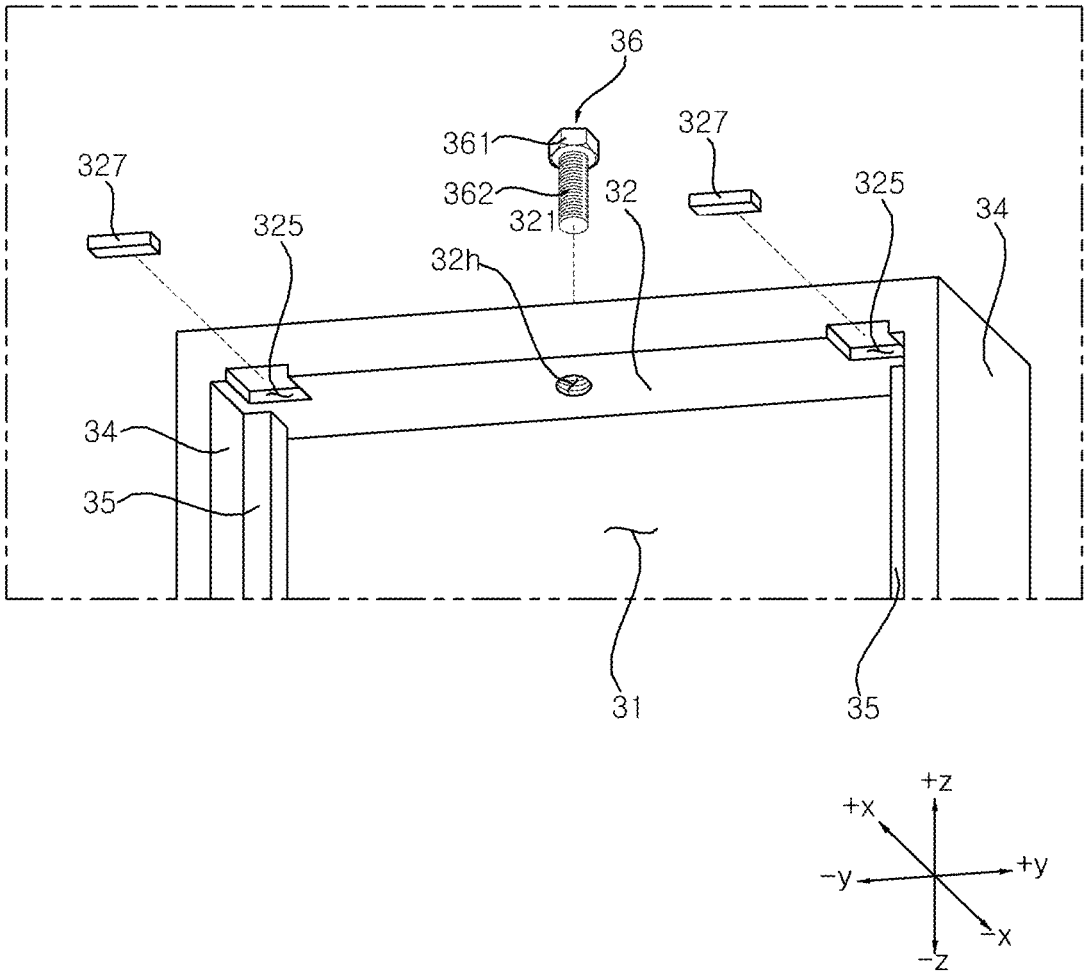
FIG. 13 is an enlarged view showing a portion of the header case 30 shown in FIG. 12. In detail.

Hereafter, referring to FIG. 13, the case groove 325 formed on the top of the header case 30 may be elongated rearward from the front end of the header case 30. The case groove 325 can guide insertion of the second coupling protrusion 217 positioned at the upper end of the header module 200. The second coupling protrusion 217 may be inserted through the front end of the case groove 325. The second coupling protrusion 217 can move rearward from the front of the case groove 325.

The header case 30 may include a cap block 327. The case groove 325 can guide insertion of the cap block 327. The cap block 327 has a width substantially the same as the width of the case groove 325, so it can be fitted in the case groove 325. The cap block 327 may be inserted through the front end of the case groove 325. The cap block 327 can come in contact with a surface of the second coupling protrusion 217 by moving rearward along the case groove 325. The cap block 327 is brazed in contact with the second coupling protrusion 217, whereby it can be coupled to the case groove 325 and the second coupling protrusion 217.

Figure 14:
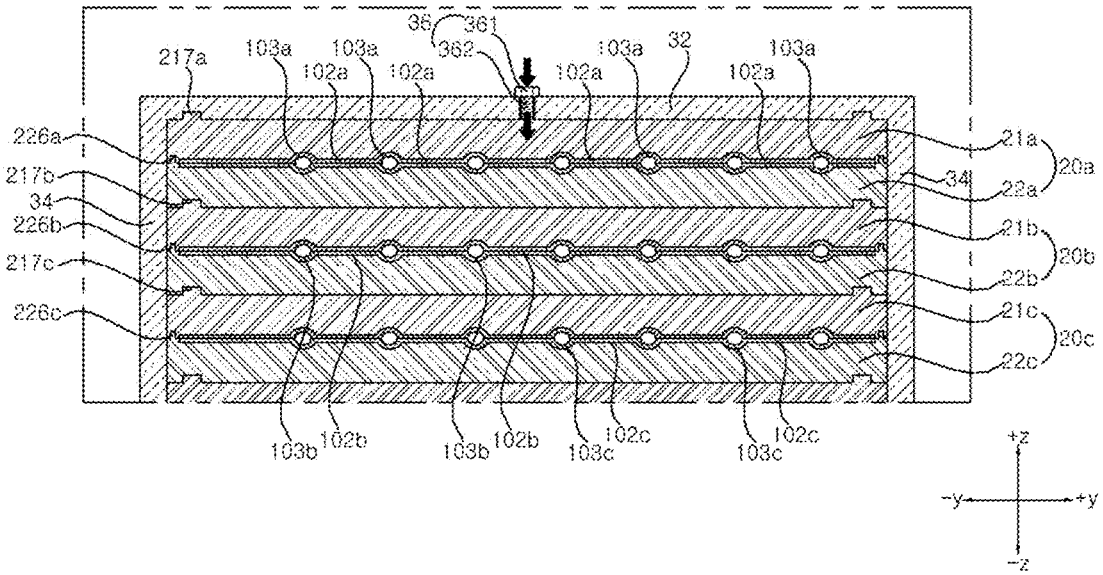
FIG. 14 is a cross-sectional view showing a cross-section of a header H.

Referring to FIGS. 13 and 14, a nut hole 32*h* may be formed on the top 32 and/or the bottom 33 of the header case 30. A pressing screw 36 can be inserted and fastened in the nut hole 32*h*. The pressing screw 36 can be inserted into the space 31 by being rotated in one direction along the nut hole 32*h*. The pressing screw 36 can be moved out of the space 31 by being rotated in another direction along the nut hole 32*h*.

The pressing screw 36 can press in the up-down direction the header module 200 inserted in the space 31 by being rotated in one direction. The pressing screw 36 can come in contact with the upper end and/or the lower end of the header module 200 by being rotated in one direction. The pressing screw 36 can come in contact with the upper coupling block 21 disposed at the upper end of the header module 200 and/or the lower coupling block 22 disposed at the lower end of the header module 200 by being rotated in one direction.

For example, the pressing screw 36 may be inserted in the nut hole 32*h* formed on the top 32. The pressing screw 36 can press downward the header module 200 by being rotated in one direction.

For example, the pressing screw 36 may be inserted in the nut hole 32*h* formed on the top 32. The pressing screw 36 can press upward the header module 200 by being rotated in one direction.

The pressing screw 36 may include a screw head 361, and a screw body 362 protruding to a side from the screw head 361 and having a thread. The screw body 362 can be fastened in the nut hole 32*h*. A thread having a corresponding space to the fitted to the thread of the screw body 362 may be formed around the nut hole 32*h*.

The plurality of fins 102 and the plurality of tubes 103 of the tube panel 10 may be arranged in the left-right direction. The pressing screw 36 may be disposed at a position corresponding to a fin 102. The pressing screw 36 may be disposed over a fin 102.

The pressing screw 36 and the nut hole 32*h* may be formed at several positions on the top 32 and/or the bottom 33 of the header case 30. The plurality of nut holes 32*h* and the plurality of pressing screws 36 may be arranged in the left-right direction.

The plurality of nut holes 32*h* and the plurality of pressing screws 36 may be disposed at positions corresponding to the positions of the plurality of fins 102. The plurality of nut holes 32*h* and the plurality of pressing screws 36 may be disposed over the plurality of fins 102.

When external force is applied to a plurality of stacked header blocks 20 in the up-down direction, bending stress or compression stress may be applied. The plurality of stacked header blocks 20 may be bent or compressed (hereafter, referred to as deformation) in the up-down direction. The deformation may occur in a direction in which the insertion holes 202, 203 formed at the header blocks 20 is decreased in size.

Accordingly, the header block 20 presses the tube panel 10 inserted in the insertion holes 202, 203, whereby the contact force between the header block 20 and tube panel 10 can be increased and they can be more stably coupled.

Accordingly, the tolerance or aperture between the header block 20 and the tube panel 10 can be reduced, and airtightness can be secured in brazing.

Figure 15:
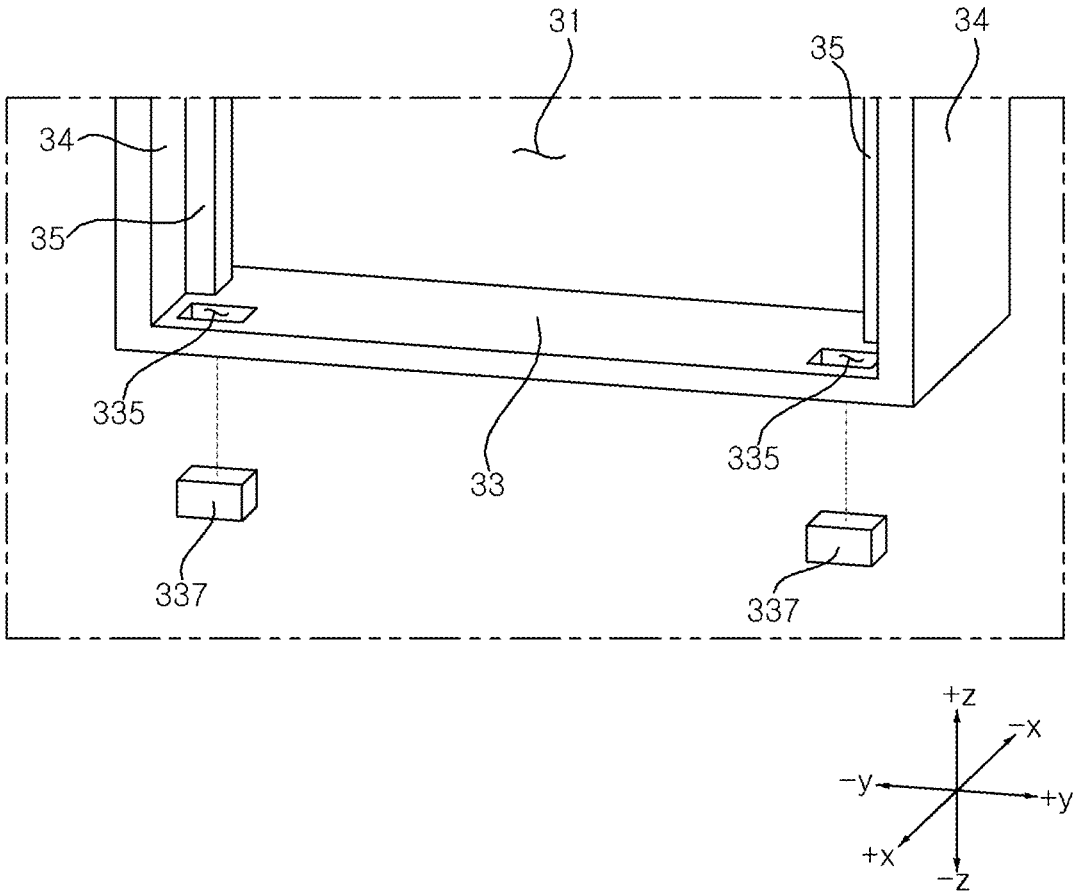
FIG. 15 is an enlarged view showing another portion of the header case 30 shown in FIG. 12.

Hereafter, referring to FIG. 15, a slit 336 may be formed by opening the bottom 33 of the header case 30. When the header module 200 is inserted in the space 31, the slit 335 can be connected to the second coupling groove 227. The slit 335 may be formed at a position corresponding to the second coupling groove 227 positioned at the lower end of the header module 200.

The insertion block 337 may have a shape corresponding to the slit 335 and may pass through the slit 335. The insertion block 337 may protrude toward the space from the bottom 33 of the header case 30 through the slit 335. The insertion block 337 may be inserted in the second coupling groove 227 through the slit 335.

Figure 16:
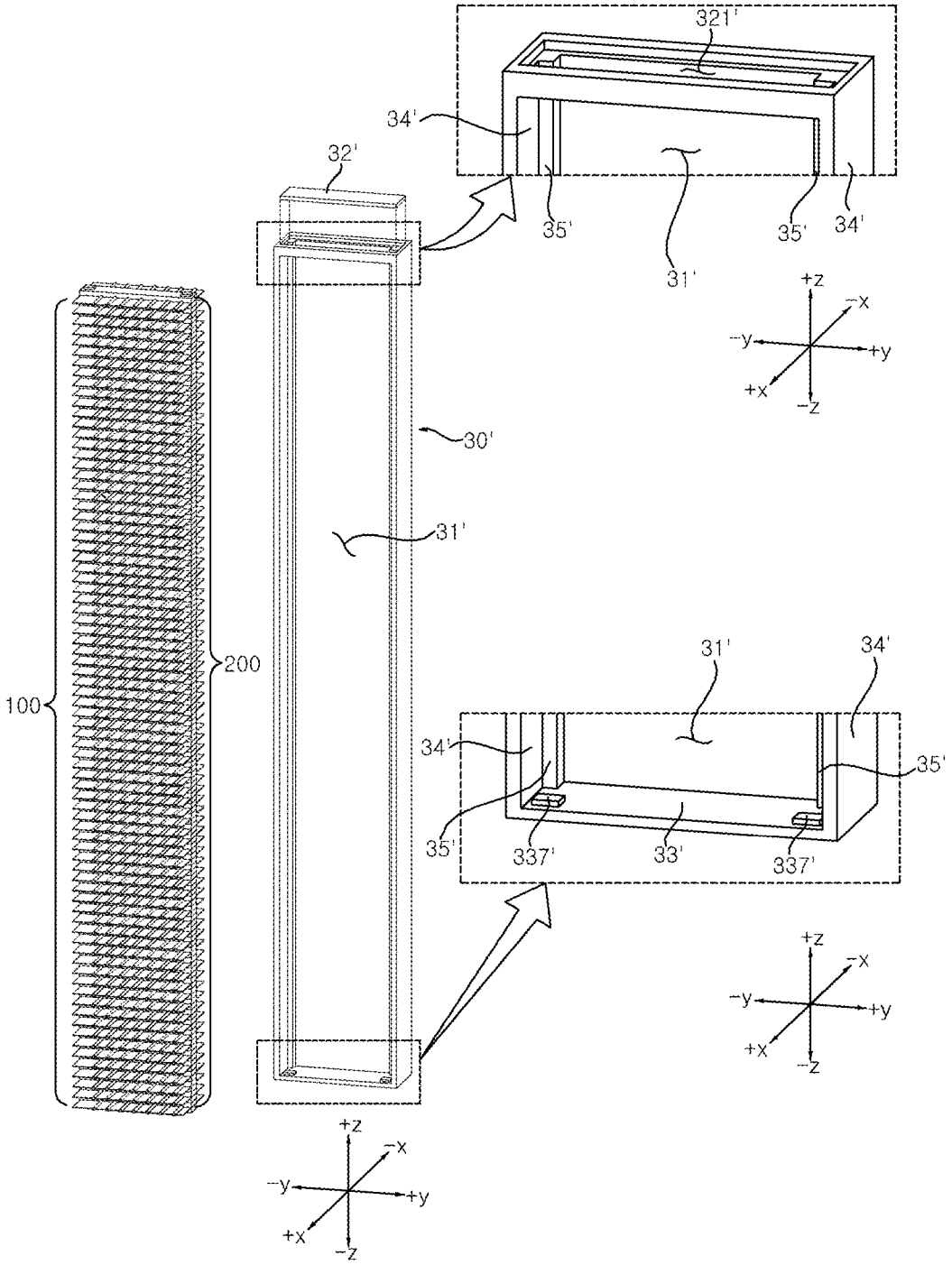
FIG. 16 is a view showing a header module 200 separated from a header case 30' according to another embodiment of the present disclosure.
Figure 17:
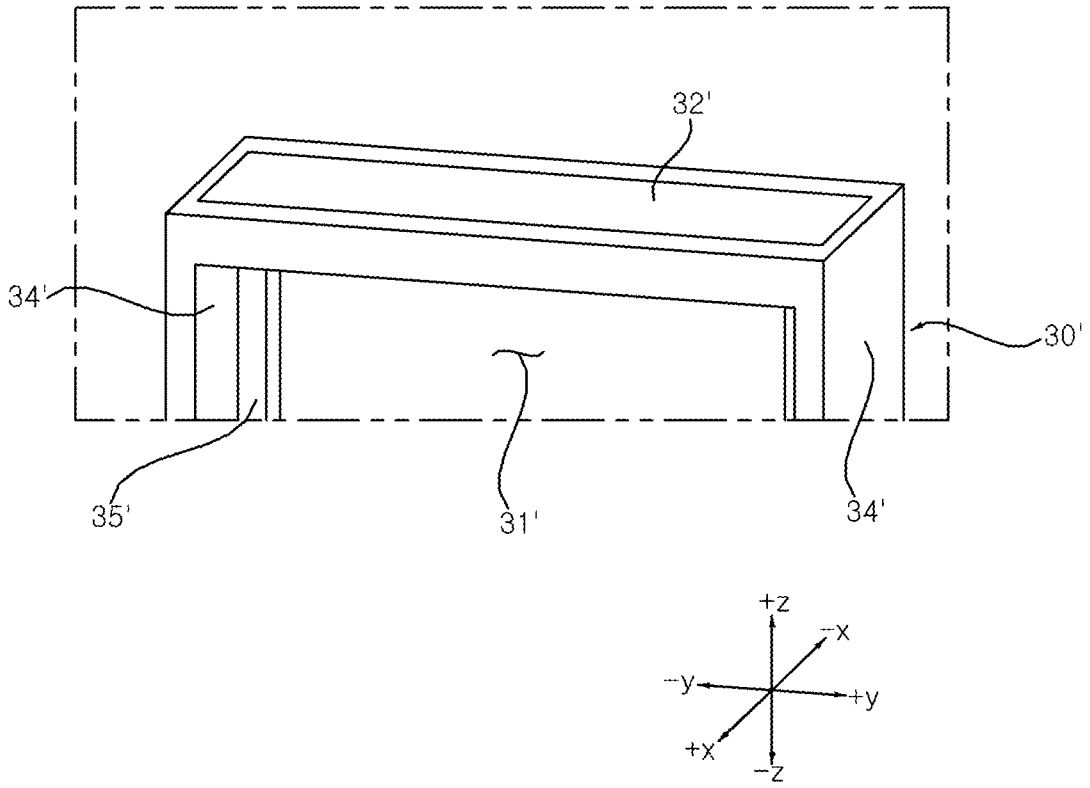
FIGS. 17 and 18 are enlarged views showing a portion of the header case 30' shown in FIG. 16.
Figure 18:
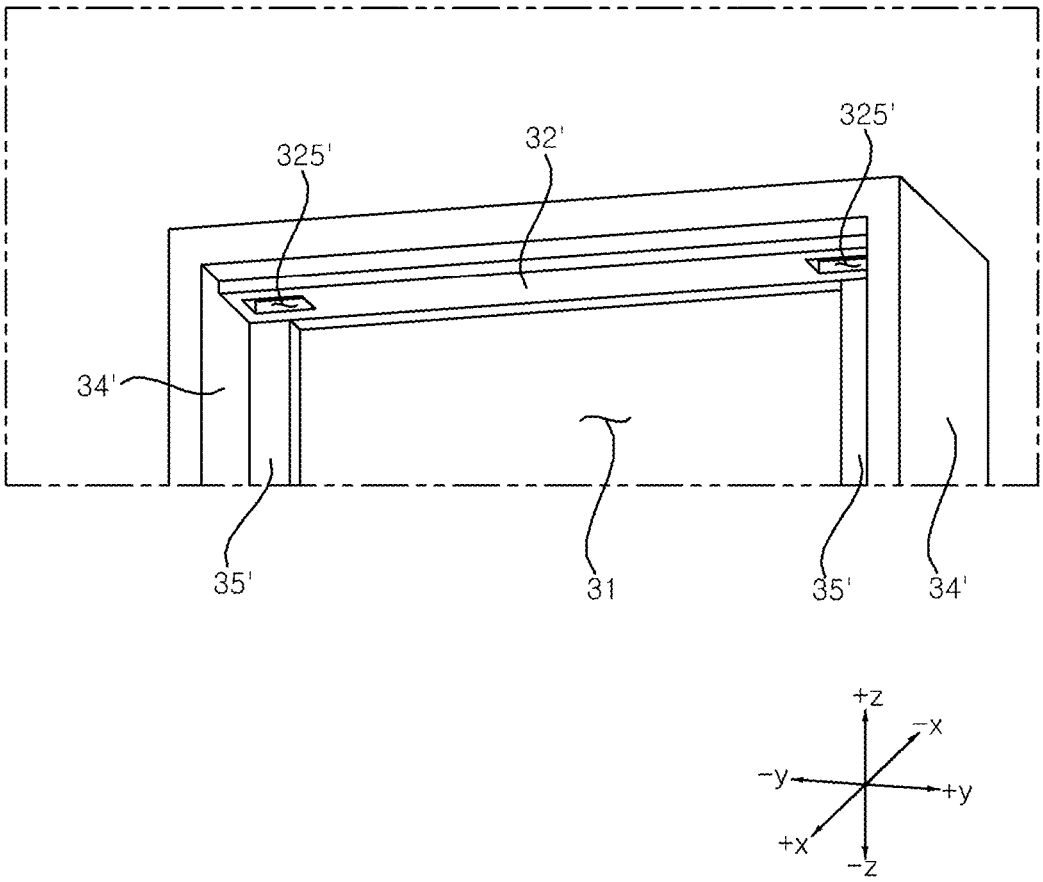

Referring to FIGS. 16 to 18, the same configuration is not described and different configuration is described between the header case 30' according to another embodiment of the present disclosure and the header case 30 described with reference to FIGS. 12 to 15.

The header case 30' according to another embodiment of the present disclosure may have an opening 321' on the top thereof. The header case 30' may include a cover block 32' inserted in the opening 321'.

The cover block 32' may have a shape corresponding to the opening 321' formed at the top of the header case 30'. The cover block 32' may be fitted in the opening 321'.

The header module 200 may be inserted in the header case 30'. The second coupling protrusion 217 may protrude from the upper end of the header module 200. The cover block 32' has a groove formed on the bottom thereof, so it can be coupled to the second coupling protrusion 217 formed at the upper end of the header module 200. The groove 325' may be formed at a position corresponding to the second coupling protrusion 217. The groove 325' may have a shape and a number corresponding to those of the second coupling protrusion 217. The groove 325' may be referred to as a case groove 325'.

Figure 19:
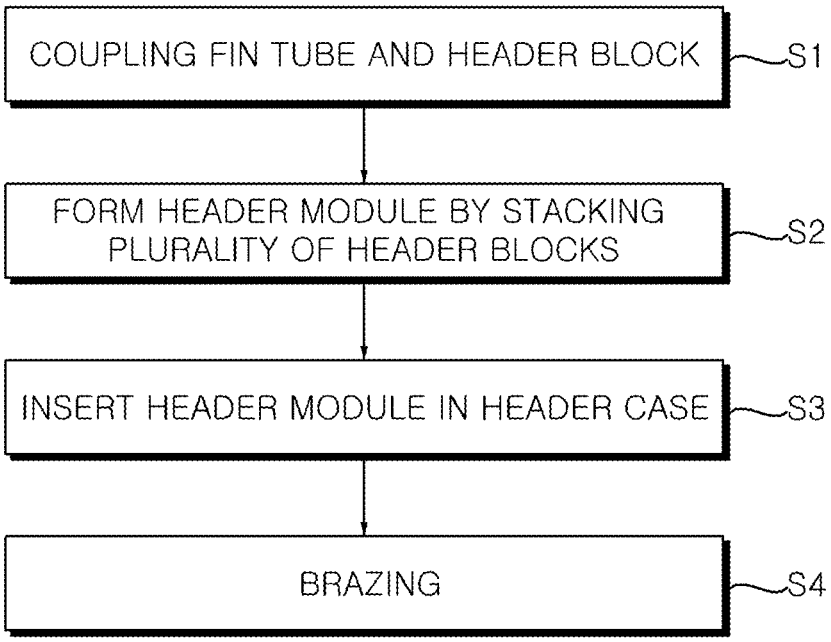
FIG. 19 is a block diagram showing a method of manufacturing a heat exchanger according to an embodiment of the present disclosure.

Hereafter, a method of manufacturing a heat exchanger according to an embodiment of the present disclosure is described with reference to FIG. 19.

The method of manufacturing a heat exchanger may include a step S1 of inserting a tube panel 10 into the insertion hole 202, 230 formed in a header block 20.

The method of manufacturing a heat exchanger may include a step S2 of forming a header module 200 by stacking a plurality of header blocks 20 with tube panels 10 inserted therein after step S1.

The method of manufacturing a heat exchanger may include a step S3 of inserting the header module 200 in the space 31 of a header case 30 after step S2.

The method of manufacturing a heat exchanger may include a step S4 of brazing the heat exchanger including the header module 200 and the header case 30 after step S3. A filer material may be applied to the insertion, contact, coupling, and assembling portions of components before brazing S4.

The step S1 of inserting a tube panel 10 into the insertion hole 202, 203 of a header block 20 may be to couple a first coupling block 21 and a second coupling block 22 up and down the tube panel 10 therebetween.

The step S2 of forming a header module may include a step of inserting a coupling protrusion 217 formed at any one of the plurality of header blocks 20 into a coupling groove 227 formed at another one of the plurality of header blocks 20.

For example, a first header block 20*a* may be coupled to the top of a second header block 20*b*. The second header block 20*b* may be coupled to the top of a third header block 20*c*. In this case, the second coupling protrusion 217*b* formed on the top of the second header block 20*b* may be inserted in the second coupling groove 217*a* formed on the bottom of the first header block 20*a*. The second coupling protrusion 217*c* formed on the top of the third header block 20*c* may be inserted in the second coupling groove 217*b* formed on the bottom of the second header block 20*b*.

Although exemplary embodiments of the present disclosure were illustrated and described above, the present disclosure is not limited to the specific exemplary embodiments and may be modified in various ways by those skilled in the art without departing from the scope of the present disclosure described in claims, and the modified examples should not be construed independently from the spirit of the scope of the present disclosure.

What is claimed is:

1. A heat exchanger comprising:

a plurality of tube panels including a plurality of tubes elongated in one direction and a plurality of fins;

a pair of header modules coupled to both ends of the plurality of tube panels; and a pair of header cases having an open side, providing a space therein, and having the pair of header modules inserted in the spaces, respectively, such that the plurality of tubes communicate with the spaces, wherein each header case has the open side, wherein the pair of header modules each includes a plurality of header blocks stacked and coupled to each other, and at least one insertion hole in which the tube panel is inserted is formed at each of the plurality of header blocks, wherein each header block of the plurality of header blocks includes an upper coupling block and a lower coupling block that forms the at least one insertion hole by being combined with each other with the tube panel therebetween, wherein the tube panel is configured such that a fin of the plurality of fins is formed by a flat portion and a recession is formed by coupling an upper panel and a lower panel, each of which has the flat portion and a recession, wherein a bottom of the upper coupling block is formed in a shape corresponding to a shape of the upper panel and is in contact with the upper panel, and wherein a top of the lower coupling block is formed in a shape corresponding to a shape of the lower panel and is in contact with the lower panel.

2. The heat exchanger of claim 1, wherein the insertion holes of the plurality of header blocks are elongated in a direction in which the tube panel is elongated.

3. The heat exchanger of claimer 1, wherein the upper coupling block includes a first coupling groove recessed upward from a bottom of the upper coupling block at both ends of the upper coupling block, and the lower coupling block includes a first coupling protrusion protruding upward from a top of the lower coupling block at both ends of the lower coupling block and inserted in the first coupling groove.

4. The heat exchanger of claimer 1, comprising a spacer disposed at both ends of the header block between the upper coupling block and the lower coupling block, and spacing the upper coupling block and the lower coupling block by a thickness of the tube panel.

5. The heat exchanger of claim 4, wherein the spacer protrudes from at least one of the upper coupling block or the lower coupling block.

6. The heat exchanger of claim 5, wherein the spacer includes:

an upper spacer protruding downward from the bottom of the upper coupling block; and a lower spacer protruding upward from the top of the lower coupling block and being in contact with the upper spacer, and wherein the header block includes:

a first coupling groove recessed upward from the upper spacer; and a first coupling protrusion protruding upward from the lower spacer and inserted in the first coupling groove.

7. The heat exchanger of claim 1, wherein the plurality of header blocks each include:

a coupling protrusion protruding upward from a top of the header block; and a coupling groove recessed upward from a bottom of the header block, and wherein the coupling protrusion of any one of the plurality of header blocks is inserted in the coupling groove of another one of the plurality of header blocks.

8. The heat exchanger of claim 1, wherein the header case includes a rib disposed adjacent to both sides of the header case in the header case, protruding forward from a rear surface of the header case, and limiting an insertion depth of the header module in contact with the header module.

9. The heat exchanger of claim 8, wherein the rib is elongated in an up-down direction and is in contact with the plurality of header blocks.

10. A heat exchanger comprising:

a plurality of tube panels including a plurality of tubes elongated in one direction and a plurality of fins;

a pair of header modules coupled to both ends of the plurality of tube panels; and a pair of header cases having an open side, providing a space therein, and having the pair of header modules inserted in the spaces, respectively, such that the plurality of tubes communicate with the spaces, wherein each header case has the open side, wherein the pair of header modules each includes a plurality of header blocks stacked and coupled to each other, and at least one insertion hole in which the tube panel is inserted is formed at each of the plurality of header blocks, wherein each header block of the plurality of header blocks includes an upper coupling block and a lower coupling block that forms the at least one insertion hole by being combined with each other with the tube panel therebetween, wherein the upper coupling block includes a second coupling protrusion protruding upward from a top of the upper coupling block, wherein the lower coupling block includes a second coupling groove recessed upward from a bottom of the lower coupling block, wherein the second coupling protrusion of any one of the plurality of header blocks is inserted in the second coupling groove of another one of the plurality of header blocks, and wherein each header case includes:

a case groove that is recessed on a top of the header case to face the space and in which the coupling protrusion positioned at an upper end of the header module is inserted; and an insertion block that protrudes to the space from a bottom of the header case and that is inserted in the coupling groove positioned at a lower end of the header module.

11. The heat exchanger of claim 10, wherein the case groove is elongated rearward from a front end of the header case and guides insertion of the coupling protrusion.

12. The heat exchanger of claim 11, wherein the header case includes a cap block inserted from a front end of the case groove, guided toward the coupling protrusion inserted in the case groove by the case groove, and being in contact with a surface of the coupling protrusion.

13. The heat exchanger of claim 10, wherein the header case includes a slit formed by opening another surface of the header case to be connected with the coupling groove, and wherein the insertion block is inserted in the coupling groove through the slit from the outside.

14. A heat exchanger comprising:

a plurality of tube panels including a plurality of tubes elongated in one direction and a plurality of fins;

a pair of header modules coupled to both ends of the plurality of tube panels; and a pair of header cases having an open side, providing a space therein, and having the pair of header modules inserted in the spaces, respectively, such that the plurality of tubes communicate with the spaces, wherein each header case has the open side, and wherein the pair of header modules each includes a plurality of header blocks stacked and coupled to each other, and at least one insertion hole in which the tube panel is inserted is formed at each of the plurality of header blocks, further comprising a pressing screw fastened in a nut hole formed on a top and/or a bottom of the header case, and pressing the header module inserted in the space in an up-down direction by being rotated in one direction.

15. The heat exchanger of claim 14, wherein the tube panel is divided into the plurality of fins and the plurality of tubes formed between the plurality of fins, and wherein the pressing screw is disposed at positions corresponding to positions of the plurality of fins.

16. A heat exchanger comprising:

a plurality of tube panels including a plurality of tubes elongated in one direction and a plurality of fins;

a pair of header modules coupled to both ends of the plurality of tube panels; and a hair of header cases having an oven side, providing a space therein, and having the pair of header modules inserted in the spaces, respectively, such that the plurality of tubes communicate with the spaces, wherein each header case has the open side, wherein the pair of header modules each includes a plurality of header blocks stacked and coupled to each other, and at least one insertion hole in which the tube panel is inserted is formed at each of the plurality of header blocks, and wherein the header case has an opening formed at a top of the header case and includes a cover block inserted in the opening and having a groove fitted to a coupling protrusion of the header module inserted in the header case.

* * * * *